US007836718B2

(12) United States Patent
Hall

(10) Patent No.: US 7,836,718 B2
(45) Date of Patent: Nov. 23, 2010

(54) HOT GAS DEFROST METHOD AND APPARATUS

(75) Inventor: David L. Hall, Piedmont, SC (US)

(73) Assignee: Electrolux Home Products, Inc., Cleveland, OH (US)

( * ) Notice: Subject to any disclaimer, the term of this patent is extended or adjusted under 35 U.S.C. 154(b) by 424 days.

(21) Appl. No.: 11/771,578

(22) Filed: Jun. 29, 2007

(65) Prior Publication Data

US 2009/0000321 A1 Jan. 1, 2009

(51) Int. Cl.

| | |
|---|---|
| ***F25B 47/00*** | (2006.01) |
| ***F25D 21/00*** | (2006.01) |
| ***F25D 21/06*** | (2006.01) |
| ***F25D 21/02*** | (2006.01) |

(52) U.S. Cl. ..... 62/278; 62/140; 62/151; 62/234

(58) Field of Classification Search ..... 62/81, 62/278, 155, 140

See application file for complete search history.

(56) References Cited

U.S. PATENT DOCUMENTS

| | | | | |
|---|---|---|---|---|
| 4,095,438 | A | 6/1978 | Kramer | |
| 4,318,277 | A | 3/1982 | Cann et al. | |
| 4,942,743 | A | 7/1990 | Gregory | |
| 4,979,371 | A | 12/1990 | Larson | |
| 5,050,400 | A | 9/1991 | Lammert | |
| 5,056,327 | A | 10/1991 | Lammert | |
| 5,469,715 | A * | 11/1995 | Janke et al. | 62/155 |
| 5,575,158 | A | 11/1996 | Vogel | |
| 5,941,085 | A | 8/1999 | Jeon | |
| 6,170,272 | B1 | 1/2001 | Backman | |
| 6,286,322 | B1 | 9/2001 | Vogel et al. | |
| 6,427,463 | B1 | 8/2002 | James | |
| 6,481,231 | B2 | 11/2002 | Vogel et al. | |
| 7,000,414 | B2 | 2/2006 | Lee et al. | |
| 2004/0168451 | A1 * | 9/2004 | Bagley | 62/196.4 |

FOREIGN PATENT DOCUMENTS

| | | | |
|---|---|---|---|
| GB | 1505711 | * | 3/1978 |
| WO | 2007001284 A | | 1/2007 |

OTHER PUBLICATIONS

A.D. Althouse, D.C. Bracciano, C.H. Turnquist. "Modern Refrigeration and Air Conditioning" The Goodheart-Willcox Company, Inc, 2000. pp. 125-128.

International Search Report for PCT/US2008/068120, dated Feb. 18, 2009, 1 page.

* cited by examiner

*Primary Examiner*—Thomas E Denion
*Assistant Examiner*—Michael Carton
(74) *Attorney, Agent, or Firm*—Pearne & Gordon LLP

(57) ABSTRACT

A method of and apparatus for defrosting an evaporator in a cooling system are provided. The cooling system includes a compressor, a condenser, an evaporator and a refrigerant that is circulated in sequence from the compressor to the condenser, to the evaporator and back to the compressor during routine operation of the cooling system. The method and apparatus comprise shutting off the flow of the refrigerant from the compressor to the evaporator through the condenser while continuing to operate the compressor so as to apply suction to the refrigerant in the evaporator and thereafter directing compressed refrigerant from the compressor to the evaporator while bypassing the condenser and continuing to shut off the flow of the refrigerant from the compressor to the evaporator through the condenser.

13 Claims, 1 Drawing Sheet

HOT GAS DEFROST METHOD AND APPARATUS

BACKGROUND OF THE INVENTION

This invention relates generally to cooling systems that employ cooling evaporators and in particular the invention relates to method and apparatus for defrosting such evaporators.

Typical cooling systems for refrigeration appliances such as refrigerators and freezers for example include an evaporator, oftentimes in the form of a coil, on which frost and ice can be formed and accumulate over a period of time. The accumulation of frost and ice on the evaporator results in the inefficient and more costly operation of the cooling system. Consequently, it is necessary to remove the frost and ice accumulation so that the cooling system can operate in an effective manner.

A practice often employed for defrosting and removing frost and ice that has accumulated or built up on an evaporator coil is to provide a heater, usually of high wattage, to heat the evaporator coil and melt the accumulated ice. Typically, a resistive heater is used and the heater tends to dissipate heat in all directions so that not only is the evaporator coil heated but the surroundings of the evaporator coil are heated as well. As a result, the compartment where the evaporator is located such as the freezer compartment or fresh food compartment of a refrigerator for example can be heated to a degree.

The frequency at which defrost cycles are carried out can be based on the passage of time using a mechanical timing device that both initiates and terminates the defrost cycle. Alternatively, an electronic circuit can be provided to control the defrost cycle using a thermostat or the like to measure the temperature at the evaporator and employing defrost algorithms.

BRIEF SUMMARY OF THE INVENTION

According to one aspect of the invention, a method of defrosting an evaporator in a cooling system that includes a compressor, a condenser, an evaporator and a refrigerant that is circulated in sequence from the compressor to the condenser, to the evaporator and back to the compressor during routine operation of the cooling system, comprises shutting off the flow of the refrigerant from the compressor to the evaporator through the condenser while continuing to operate the compressor so as to apply suction to the refrigerant in the evaporator and directing compressed refrigerant from the compressor to the evaporator while bypassing the condenser and continuing to shut off the flow of the refrigerant from the compressor to the evaporator through the condenser.

According to another aspect, a method is provided for defrosting an evaporator in a cooling system as described in the previous paragraph wherein the method comprises initially shutting off the flow of the refrigerant from the compressor to the evaporator through the condenser for a first period of time while continuing to operate the compressor so as to apply suction to the refrigerant in the evaporator. The compressor is then turned off for a second period of time at the expiration of the first period of time and refrigerant is circulated between the compressor and the evaporator while bypassing the condenser and continuing to shut off the flow of the refrigerant from the compressor to the evaporator through the condenser. Thereafter, the compressor is turned on at the expiration of the second period of time and the compressed refrigerant is directed from the compressor to the evaporator for a third period of time while bypassing the condenser and continuing to shut off the flow of the refrigerant from the compressor to the evaporator through the condenser.

According to yet another aspect, a cooling system including defrosting components comprises a compressor having an inlet and an outlet, a condenser having an inlet and an outlet, an evaporator having an inlet and an outlet and a refrigerant. The outlet of the compressor is in flow communication with the inlet of the condenser along a first flow path whereby refrigerant may flow from the compressor to the condenser. Also, the outlet of the condenser is in flow communication with the inlet of the evaporator along a second flow path whereby refrigerant may flow from the condenser to the evaporator. In addition, the outlet of the evaporator is in flow communication with the inlet of the compressor along a third flow path whereby the refrigerant may flow from the evaporator to the compressor. Further, the outlet of the compressor is in flow communication with the inlet of the evaporator along a fourth flow path that bypasses the condenser whereby refrigerant may flow from the compressor to the evaporator and bypass the condenser. A first valve arrangement is located in the second flow path for selectively opening and closing the second flow path to the flow of the refrigerant from the compressor to the evaporator through the condenser. A second valve arrangement is located in the fourth flow path for selectively opening and closing the fourth flow path to the flow of refrigerant from the compressor to the evaporator along the fourth flow path.

DETAILED DESCRIPTION OF THE INVENTION

Figure 1:
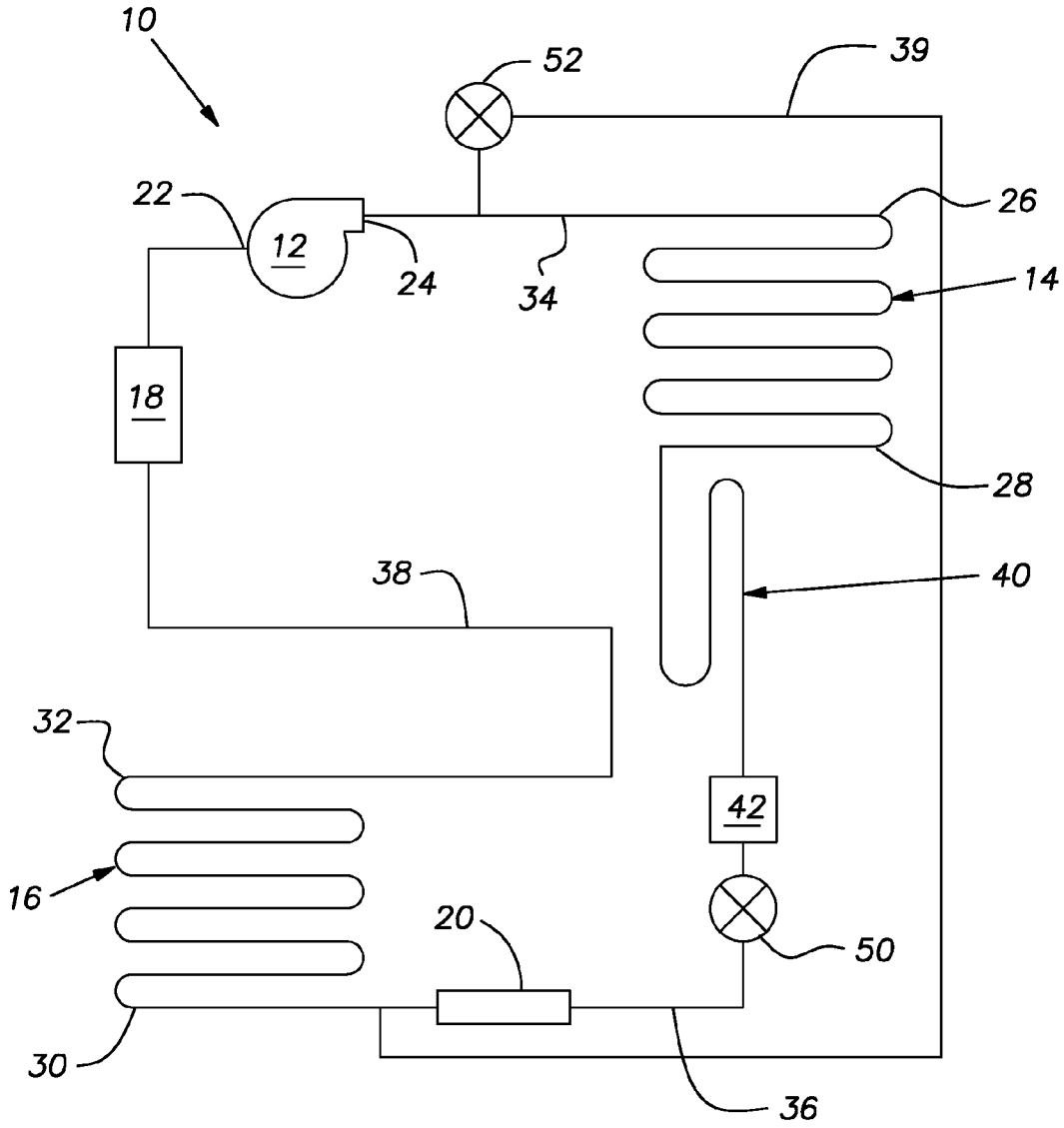
FIG. 1 of the drawing is a schematic illustration of an embodiment of a defrosting method and apparatus according to the invention.

FIG. 1 shows a cooling system, indicated generally at 10, of the type that can be used with a refrigeration appliance for example. The cooling system comprises a compressor 12, a condenser 14 and an evaporator 16. The cooling system also can include an accumulator 18 and a flow-restricting device 20 such as a capillary tube for example. A refrigerant, sometimes in a liquid state, sometimes in a gaseous state and sometimes in both a liquid and gaseous state, is contained within the cooling system 10 and provides the means by which a cooling effect is produced at the evaporator 16. The compressor 12 includes an inlet 22 and an outlet 24; the condenser includes an inlet 26 and an outlet 28; and the evaporator includes an inlet 30 and an outlet 32.

The outlet 24 of the compressor 12 is in flow communication with the inlet 26 of the condenser 14 through conduit 34 along a first flow path whereby refrigerant may flow from the compressor to the condenser. The outlet 28 of the condenser 14 is in flow communication with the inlet 30 of the evaporator 16 through conduit 36 along a second flow path whereby refrigerant may flow from the condenser to the evaporator. The outlet 32 of the evaporator 16 is in flow communication with the inlet 22 of the compressor 12 through a conduit 38 along a third flow path whereby the refrigerant may flow from the evaporator to the compressor. The outlet 24 of the compressor 12 also is in flow communication with the inlet 30 of the evaporator 16 through conduit 39 along a fourth flow path that bypasses the condenser 14 whereby refrigerant under selected circumstances may flow from the compressor to the evaporator and bypass the condenser.

During routine operation of the cooling system 10, or when the cooling system is in a cooling mode of operation, the compressor 12 pumps heat-laden refrigerant vapor from the evaporator 16 through evaporator outlet 32 and conduit or suction line 38 into the compressor through compressor inlet 22. This causes a low pressure to be maintained in the evaporator. The heat-laden refrigerant vapor is compressed by the compressor 12 and the temperature and pressure of the vapor are increased. The resulting hot, high-pressure refrigerant vapor from the compressor 12 exits the compressor through compressor outlet 24 and passes through conduit 34 along the first flow path into the condenser 14 through the condenser inlet 26. The condenser 14 can comprise a series of tubes in the form of a tube coil through which the hot, high-pressure refrigerant vapor from the compressor passes. Air is forced through the condenser coil by a blower fan, not shown, for example and heat is given up to the air by the vaporous refrigerant causing the refrigerant vapor to condense to a liquid. The resulting liquid refrigerant of a medium temperature and at a high pressure is then directed from the condenser 14 through condenser outlet 28 and into conduit 36 along the second flow path.

At least in those instances where the cooling system is used with a refrigerator and the evaporator is located in the freezer compartment of the refrigerator, an eliminator tube 40 can be provided. In that case, the eliminator would supply warmth to the perimeter flange of the freezer so as to prevent water condensation at that location. In addition, a receiver 42 for storing the liquid refrigerant after it leaves the condenser 14 can be in flow communication with the conduit 36 downstream of the eliminator tube 40.

A metering device 20 such as a capillary tube for example is located in the second flow path in conduit 36 between the outlet 28 of the compressor 14 and the inlet 30 of the evaporator 16. Other types of metering devices such as a thermostatic expansion valve for example may be used rather than a capillary tube. The capillary tube controls the flow of the refrigerant further along conduit 36 into the evaporator through evaporator inlet 30. The capillary tube primarily reduces the pressure of the liquid refrigerant to a pressure that corresponds to the evaporator temperature at a saturated condition. In the evaporator 16, the saturated refrigerant absorbs heat from the evaporator surroundings cooling those surroundings and boils into a low pressure vapor. A blower can be provided to draw the cooled air to locations away from the evaporator. The heat-laden low pressure vapor is then drawn to the compressor 12 through the evaporator outlet 32 and along the third flow path in the conduit 38 and through the compressor inlet 22.

An accumulator 18 can be in flow communication with conduit 38 for storing liquid refrigerant so as to ensure that the evaporator 16 will be fully flooded with refrigerant as is familiar to those having ordinary skill in the art.

The present invention is not limited to a cooling system having or limited to the specific structures and components described above and can be used with other cooling systems as will be understood by those having ordinary skill in the art. For example, the cooling systems to which the subject invention has applicability can include water-cooled and evaporative condensers rather than air-cooled condensers. Additionally, the cooling system of the invention can be variously applied. Thus, the cooling system can be employed with refrigeration appliances such as refrigerators, freezers and combinations thereof for example. Also the cooling system of the invention can be used with air conditioning systems and generally wherever a cooling effect is desired to be employed. In any event, it is the case with such cooling systems that condensed water in the form of frost, ice or the like will build up on the system evaporator. The frost and ice acts as an insulator thereby inhibiting heat transfer between the evaporator and the evaporator surroundings and reducing the efficient operation of the cooling system. Consequently, it is necessary to thaw or melt such frost or ice formations on the evaporator so as to defrost the evaporator.

According to the subject invention, the formation of frost, ice or the like at the evaporator of a cooling system is melted or thawed and the evaporator defrosted by circulating hot refrigerant through the evaporator. As illustrated in the embodiment of the invention of FIG. 1, the melting of the frost or ice is accomplished by shutting off the flow of refrigerant from the condenser 14 to the evaporator 16 and directing hot refrigerant from the compressor 12 directly to the evaporator and bypassing the condenser 14. More specifically with reference to FIG. 1, a first valve arrangement 50 is located in the second flow path through conduit 36 for selectively opening and closing the second flow path to the flow of refrigerant from the compressor 12 to the evaporator 16 through the condenser 14. And a second valve arrangement 52 is located in a fourth flow path through conduit 39 for selectively opening and closing the fourth flow path to the flow of the refrigerant from the compressor to the evaporator along the fourth flow path.

At such time as the cooling system is operating in its cooling mode as described above, the first valve arrangement 50 is adapted to selectively open the second flow path to the flow of refrigerant from the condenser 14 to the evaporator 16 through conduit 36 and the second valve arrangement 52 is adapted to selectively close the fourth flow path to the flow of refrigerant from the compressor 12 to the evaporator 16 through conduit 39. During the cooling mode, the compressor 12 is adapted to be in operation. When frost or ice build-up on the evaporator 16 is to be melted and the evaporator defrosted such that cooling system is in a defrosting mode of operation, the first valve arrangement 50 is adapted to selectively close the second flow path to the flow of refrigerant from the condenser 14 to the evaporator 16 through conduit 36 and the second valve arrangement 52 is adapted to selectively open the fourth flow path to the flow of refrigerant from the compressor 12 to the evaporator through the conduit 39. The compressor 12 is adapted to be in operation during the defrosting mode of operation.

In addition to a cooling mode of operation and a defrosting mode of operation, the invention has a vaporizing mode of operation and can have an equilibrating mode of operation. In the vaporizing mode of operation, which follows the cooling mode of operation and precedes both the defrosting mode of operation and the equilibrating mode of operation, the first valve arrangement 50 is adapted to selectively close the second flow path to the flow of refrigerant from the condenser 14 to the evaporator 16 through conduit 36, the second valve arrangement 52 is adapted to selectively close the fourth flow path to the flow of refrigerant from the compressor 12 to the evaporator 16 through conduit 39 and the compressor 12 is adapted to be in operation.

In the equilibrating mode of operation, which follows the vaporizing mode of operation and precedes the defrosting mode of operation, the first valve arrangement 50 is adapted to selectively close the second flow path to the flow of refrigerant from the condenser 14 to the evaporator 16 through the conduit 36, the second valve arrangement 52 is adapted to selectively open the fourth flow path to the flow of refrigerant from the compressor 12 to the evaporator 16 through the conduit 36 and the compressor 12 is adapted to be inoperative.

A further description of the operation of the embodiment of the invention shown in FIG. 1 is best presented with reference to the several operational modes that the cooling system undergoes. Beginning with the cooling mode of operation, a description of the cooling system in a cooling mode of operation is set forth in detail above and is not repeated here. Considering the other operational modes that the cooling system undergoes, at such time during the course of the cooling mode of operation as frost or ice have built up at the evaporator to a degree that the evaporator requires defrosting, the cooling system proceeds to the vaporizing mode of operation where, as indicated, the first valve arrangement 50 is activated to advance from the open position it maintains during the cooling mode of operation to a closed position whereby refrigerant cannot pass from the condenser 14 to the evaporator. At the same time, the second valve arrangement 52 maintains the closed position it had during the cooling mode of operation and the compressor 12 continues to operate. As a result of the continued operation of the compressor 12, the pressure at the evaporator 16 is progressively reduced and the refrigerant in liquid form in the evaporator vaporizes. At the same time the pressure in the evaporator is being reduced, the temperature in the evaporator drops, resulting in the dropping of the refrigerant saturation point. The saturation point continues to drop until the available latent heat in the liquid refrigerant in the evaporator is insufficient to maintain the reduced saturation point. At that point, the saturation point of the liquid refrigerant begins to increase thereby increasing the temperature of the evaporator. Concurrently, the liquid refrigerant continues to vaporize until the refrigerant in the evaporator is substantially vapor.

Following the vaporizing mode of operation of the cooling system, the cooling system can proceed to an equilibrating mode of operation or directly to a defrosting mode of operation as described below. In the equilibrating mode of operation, the first valve arrangement 50 closes the flow of refrigerant from the condenser 12 to the evaporator 16 through conduit 36, the second valve arrangement 52 opens the flow of refrigerant from the compressor 12 to the evaporator 16 through conduit 39 and the compressor 12 is turned off. During the equilibrating mode of operation of the cooling system, the vaporized refrigerant will circulate between the compressor 12 and the evaporator 16 under the pressure and temperature differentials that exist in the system until the pressures and temperatures in the system are substantially equalized.

Following the equilibration mode of operation, if one is performed, the cooling system proceeds to a defrosting mode of operation. During the defrosting mode of operation, the first valve arrangement 50 continues to close the flow of refrigerant from the condenser 14 to the evaporator 16, the second valve arrangement opens the flow of refrigerant from the compressor 12 to the evaporator 16 through conduit 39 and the compressor 12 is turned on. In the defrosting mode of operation, the compression of the refrigerant in the compressor heats up the refrigerant and the hot refrigerant, substantially in gaseous form, as it passes through the evaporator 16 will melt the frost and ice that has formed at the evaporator. At the conclusion of the defrosting mode of operation of the cooling system, the cooling system returns to the cooling mode of operation wherein the first valve arrangement 50 opens the flow of refrigerant from the condenser 14 to the evaporator 16 through conduit 36, the second valve arrangement 52 closes the flow of refrigerant from the compressor to the evaporator through conduit 39 and the compressor 12 continues to operate.

The sequencing of the cooling system 10 from a cooling mode of operation, to a vaporizing mode of operation, to an equilibrating mode of operation, to a defrosting mode of operation and back to a cooling mode of operation can be variously accomplished. For example, a microprocessor can be provided to control the operations of the several components of the cooling system and a timing mechanism can be operatively associated with the microprocessor to cause the cooling system to proceed to its various modes of operation at selected time intervals. Thus, after the cooling system has been functioning in a cooling mode of operation for a defined period of time, the cooling system can proceed to the vaporizing mode of operation for a first period of time as delineated by the timing mechanism. Thereafter, the cooling system can proceed to the equilibrating mode of operation for a second period of time as delineated by the timing mechanism after which the cooling system can proceed to the defrosting mode of operation for a third period of time as delineated by the timing mechanism. At the conclusion of the third period of time, the microprocessor would cause such functions to be performed among the components of the cooling system that are required for the cooling system to return to the cooling mode of operation.

The microprocessor could also be used to control the functioning of the components of the cooling system in response to system conditions rather than merely to the passage of time. For example, a temperature sensing device could be located at the cooling system evaporator and the temperature as sensed by the temperature sensing device and conveyed to the microprocessor could be used to trigger certain of the operating modes of the cooling system. By way of a further example, the microprocessor can be programmed to be responsive to energy being consumed in the cooling system such as at the compressor and thereby control the sequencing of the operating modes of the cooling system. Thus, for example, when frost or ice have built up on the evaporator, the power consumed to continue operating the cooling system in the cooling mode increases and this circumstance can be used as the signal to the microprocessor to shut off the cooling mode and proceed to the operating modes that result in the defrosting of the evaporator. Additionally, combinations of these control schemes can be implemented so that the operating sequence of the cooling system functions both in response to the passage of time and system conditions as will be obvious to those having ordinary skill in the art.

With respect to the first valve arrangement and the second valve arrangement, solenoid valves, for example, which have the ability to automatically open and close, can be used. The solenoid valves can function in response to directives from the microprocessor or they can be controlled otherwise such as by a thermostat for example.

Based on the foregoing descriptions and explanation, it will be appreciated that the subject invention provides for a method of defrosting an evaporator in a cooling system comprising a compressor, a condenser, an evaporator and a refrigerant that is circulated in sequence from the compressor to the condenser, to the evaporator and back to the compressor during routine operation of the cooling system. The method comprises shutting off the flow of the refrigerant from the compressor to the evaporator through the condenser while continuing to operate the compressor so as to apply suction to the refrigerant in the evaporator and directing compressed refrigerant from the compressor to the evaporator while bypassing the condenser and continuing to shut off the flow of the refrigerant from the compressor to the evaporator through the condenser.

In another aspect, the method of the invention can further comprise shutting off the flow of the refrigerant from the compressor to the evaporator through the condenser for a first period of time while continuing to operate the compressor so as to apply suction to the refrigerant in the evaporator; turning off the compressor for a second period of time at the expiration of the first period of time and circulating the refrigerant between compressor and the evaporator while bypassing the condenser and continuing to shut off the flow of the refrigerant from the compressor to the evaporator through the condenser; and turning on the compressor at the expiration of the second period of time and directing the compressed refrigerant from the compressor to the evaporator for a third period of time while bypassing the condenser and continuing to shut off the flow of the refrigerant from the compressor to the evaporator through the condenser.

In the method of the invention, applying suction to the refrigerant in the evaporator for a first period of time results in the lowering of the pressure and the temperature in the evaporator while turning off the compressor at the expiration of the first period of time and circulating the refrigerant between the compressor and the evaporator while bypassing the condenser and continuing to shut off the flow of the refrigerant from the compressor to the evaporator through the condenser results in an increase in the temperature of the refrigerant at the evaporator. Turning on the compressor at the expiration of the second period of time and directing the compressed refrigerant from the compressor to the evaporator while bypassing the condenser and continuing to shut off the flow of the refrigerant from the compressor to the evaporator through the condenser results in increasing the temperature of the refrigerant at the evaporator and the defrosting of the evaporator.

The first period of time can be set to expire substantially at such time as the amount of latent heat in the liquid phase of the refrigerant at the evaporator is insufficient to convert the liquid phase of the refrigerant at the evaporator to the gaseous phase of the refrigerant. This can be accomplished by having the first period of time expire when a pre-selected time has been reached, when the temperature at the evaporator reaches a pre-selected temperature or when the energy being consumed at the compressor is at a pre-selected level. The second period of time can be set to expire when the temperature at the evaporator reaches a pre-selected level. The third period of time can be set to expire when either the temperature at the evaporator has reached a pre-selected level or a pre-selected time has been reached.

In general, interrupting the cooling mode of operation of the cooling system by shutting off the flow of the refrigerant from the compressor to the evaporator through the condenser while continuing to operate the compressor so as to apply suction to the refrigerant in the evaporator can be initiated when a pre-selected time has been reached, when the temperature at the evaporator has reached a pre-selected level or when the energy being consumed at the compressor is at a pre-selected level.

While particular embodiments of the invention have been described herein, it is to be understood that the invention is not limited to those embodiments but covers and includes any and all modifications and variations that are encompassed by the following claims.

What is claimed is:

1. A method of defrosting an evaporator in a cooling system that includes a compressor, a condenser, an evaporator and a refrigerant that is circulated in sequence from the compressor to the condenser, to the evaporator and back to the compressor during routine operation of the cooling system, the method comprising:

shutting off the flow of the refrigerant from the compressor to the evaporator through the condenser while continuing to operate the compressor so as to apply suction to the refrigerant in the evaporator;

turning off the compressor for a period of time and circulating the refrigerant between the compressor and the evaporator while bypassing the condenser; and directing compressed refrigerant from the compressor to the evaporator while bypassing the condenser and continuing to shut off the flow of the refrigerant from the compressor to the evaporator through the condenser.

2. A method of defrosting an evaporator in a cooling system comprising a compressor, a condenser, an evaporator and a refrigerant that is circulated in sequence from the compressor to the condenser, to the evaporator and back to the compressor during routine operation of the cooling system, the method comprising:

shutting off the flow of the refrigerant from the compressor to the evaporator through the condenser for a first period of time while continuing to operate the compressor so as to apply suction to the refrigerant in the evaporator;

turning off the compressor for a second period of time at the expiration of the first period of time and circulating the refrigerant between compressor and the evaporator while bypassing the condenser and continuing to shut off the flow of the refrigerant from the compressor to the evaporator through the condenser; and turning on the compressor at the expiration of the second period of time and directing the compressed refrigerant from the compressor to the evaporator for a third period of time while bypassing the condenser and continuing to shut off the flow of the refrigerant from the compressor to the evaporator through the condenser.

3. The method of claim 2 wherein:

applying suction to the refrigerant in the evaporator for a first period of time results in the lowering of the pressure and the temperature in the evaporator;

and the first period of time expires substantially at such time as the amount of latent heat in the liquid phase of the refrigerant at the evaporator is insufficient to convert the liquid phase of the refrigerant at the evaporator to the gaseous phase of the refrigerant.

4. The method of claim 3 wherein:

turning off the compressor at the expiration of the first period of time and circulating the refrigerant between the compressor and the evaporator while bypassing the condenser and continuing to shut off the flow of the refrigerant from the compressor to the evaporator through the condenser results in an increase in the temperature of the refrigerant at the evaporator;

and the second period of time expires when the temperature at the evaporator reaches a pre-selected level.

5. The method of claim 4 wherein;

turning on the compressor at the expiration of the second period of time and directing the compressed refrigerant from the compressor to the evaporator while bypassing the condenser and continuing to shut off the flow of the refrigerant from the compressor to the evaporator through the condenser results in increasing the temperature of the refrigerant at the evaporator and the defrosting of the evaporator;

and the third period of time expires when either the temperature at the evaporator has reached a pre-selected level or a pre-selected time has been reached.

6. The method of claim 2 wherein:

the first period of time expires when a pre-selected time has been reached, when the temperature at the evaporator reaches a pre-selected temperature or when the energy being consumed at the compressor is at a pre-selected level.

7. The method of claim 6 wherein:

the second period of time expires when the temperature at the evaporator reaches a pre-selected level.

8. The method of claim 7 wherein:

the third period of time expires when either the temperature at the evaporator has reached a pre-selected level or a pre-selected time has been reached.

9. The method of claim 8 wherein;

shutting off the flow of the refrigerant from the compressor to the evaporator through the condenser while continuing to operate the compressor so as to apply suction to the refrigerant in the evaporator is initiated when a pre-selected time has been reached, when the temperature at the evaporator has reached a pre-selected level or the energy being consumed at the compressor is at a pre-selected level.

10. The method of claim 2 further comprising the step of:

opening and closing a first valve arrangement to control the flow of refrigerant from the condenser to the evaporator through the condenser.

11. The method of claim 10 further comprising the step of:

opening and closing a second valve arrangement to control the flow of refrigerant from the compressor to the evaporator while bypassing the condenser.

12. The method of claim 2 further comprising the step of:

selectively turning on and off the compressor in response to the expiration of the first period of time while the cooling system continues to operate.

13. The method of claim 2 wherein:

turning off the compressor for a second period of time at the expiration of the first period of time results in the equalization of the pressure and temperature in the cooling system.

* * * * *